United States Patent [19]

Adrian et al.

[11] Patent Number: 4,478,737

[45] Date of Patent: Oct. 23, 1984

[54] LIQUID OXIDATIVE DESIZING AGENT AND PROCESS FOR OXIDATIVE DESIZING

[75] Inventors: Klaus Adrian, Frankfurt am Main; Günter Rösch, Bad Soden am Taunus, both of Fed. Rep. of Germany

[73] Assignee: Hoechst Aktiengesellschaft, Fed. Rep. of Germany

[21] Appl. No.: 478,245

[22] Filed: Mar. 24, 1983

[30] Foreign Application Priority Data

Mar. 30, 1982 [DE] Fed. Rep. of Germany ..... 3211677

[51] Int. Cl.[3] ..... D06L 1/14

[52] U.S. Cl. ..... 252/186.25; 8/138; 252/102

[58] Field of Search ..... 252/102, 186.25; 8/138

[56] References Cited

U.S. PATENT DOCUMENTS 2,173,040 9/1939 Muller ..... 8/138

4,309,298 1/1982 Adrian et al. ..... 8/138

*Primary Examiner*—Christine M. Nucker

*Attorney, Agent, or Firm*—Connolly & Hutz

[57] ABSTRACT

Oxidative desizing agent consisting substantially of from 5 to 20 weight % of sodium or ammonium persulfate or potassium, sodium, ammonium or calcium peroxodiphosphate, from 20 to 50 weight % of one or more surfactants selected from the group of $C_8$–$C_{20}$-sec.-alkanesulfonates, $C_4$–$C_{12}$-alkylphenol-oxethylates having 6 to 12 ethylene oxide moieties, or $C_{10}$–$C_{18}$-fatty alcohol-oxethylates having 3 to 8 ethylene oxide moieties, and water in the amount remaining to give 100%. The advantage of this desizing agent resides in the fact that a substantially smaller amount of persulfate is required than for desizing with persulfate alone. Moreover, this desizing agent is liquid and thus easy to be dosed.

2 Claims, No Drawings

LIQUID OXIDATIVE DESIZING AGENT AND PROCESS FOR OXIDATIVE DESIZING

It is known that persulfates are used for the oxidative desizing of fabrics of cellulose fibers or their mixtures with synthetic fibers, because persulfate excellently degrades starches such as potato, rice, corn or tapioca starch in the presence of alkali. The disadvantage of desizing with persulfates resides in the fact that the cellulose fibers are easily damaged, which is expressed by a pronounced decrease of the average polymerization degree.

From German Offenlegungsschrift No. 2,913,177 it is furthermore known that a suitable potassium persulfate/surfactant combination allows to attain the same desizing effect by a substantially lower persulfate concentration. Such surfactant/potassium persulfate combinations are prepared in the form of ready-to-use formulations. In order to ensure a sufficient storage stability, they are highly viscous or pasty, so that they have to be dissolved separately before use. This is a serious drawback for application in the industrial practice, because preliminary dissolution means additional work, and furthermore the textile material is locally damaged by insufficiently dissolved persulfate particles. Moreover, in the case of bulk consumers, the individual components are generally added to the desizing, boiling or bleaching liquors by means of dosage pumps, so that products are required which are capable of being pumped and properly dosed. However, it was hitherto impossible to produce such liquid potassium persulfate/surfactant combinations capable of being dosed in the concentration as required by the textile industry.

Surprisingly, it has now been found that liquid persulfate/surfactant combinations stable to storage are obtained when selected anionic and nonionic surfactants are used, and sodium or ammonium persulfate or peroxodiphosphates are incorporated instead of potassium persulfate.

Subject of the invention is a novel oxidative desizing agent consisting substantially of from 5 to 20 weight % of sodium or ammonium persulfate or potassium, sodium, ammonium or calcium peroxodiphosphate, from 20 to 50 weight % of one or more surfactants selected from the group of $C_8$–$C_{20}$–sec.–alkanesulfonates, $C_4$–$C_{12}$–alkylphenol–oxethylates having 6 to 12 ethylene oxide moieties, or $C_{10}$–$C_{18}$–fatty alcohol–oxethylates having 3 to 8 ethylene oxide moieties, and water in the amount remaining to give 100%.

The above groups of surfactants may be used alone or in combination with one another. Preferred are mixtures of one alkanesulfonate and one of the two nonionic surfactants in a weight ratio of from 1:6 to 6:1.

The desizing agent is obtained by dissolving the persulfate or peroxodiphosphate in the surfactant(s) for 1 to 2 hours at about 50° C., cooling the batch and diluting it with the necessary amount of water.

This surfactant/persulfate or peroxodiphosphate mixture is suitable for desizing fabrics containing cellulose fibers alone or in admixture with synthetic fibers. The fabric is impregnated with an aqueous solution of this desizing agent while simultaneously adding alkali, preferably sodium hydroxide solution. The moisture content of the material so impregnated is adjusted by squeezing to about 100%, and subsequently the fabric is treated at 20° to 160° C. for a period of time ranging from 30 seconds to 24 hours. The treatment time depends on the corresponding process-specific temperature and the kind of apparatus used. The concentration of the above desizing agent in the aqueous liquor is from 0.5 to 3, preferably 0.8 to 2, weight %, calculated on a supposed squeezing effect of 100%. The amount of alkali to be added is chosen as usual in such a manner that the liquor is maintained constantly at a pH of above 10, for which purpose generally from 0.1 to 10, preferably 0.3 to 4, weight % of solid sodium hydroxide are required. After the treatment, the fabric is advantageously washed for 10 to 60 seconds with hot water of about 55° to 95° C., and subsequently rinsed with cold water. In order to increase the washing-out effect, alkali and detergents are advantageously added further to the washing water.

The desizing process can be combined with a usual bleaching process. In this case, the fabric is impregnated with an aqueous liquor which contains from 30 to 60 ml of 35% $H_2O_2$ per liter of liquor, and sodium silicate as stabilizer in addition to the desizing agent and the alkali. The impregnated fabric is squeezed to about 100% of moisture also in this case, and stored for 6 to 24 hours at room temperature or steamed for a short time at about 100° C. The fabric is then washed out; alkali and detergent being added in order to increase the degradation of the sizing agent.

The advantage of the desizing agent of the invention resides in its being liquid and therefore easy to be dosed. Furthermore, it is very stable to storage, that is, up to 6 months at 30° C. Moreover, this combination allows to decrease the amount of per compound required for desizing to 25% of the amount necessary when using a per compound alone. This decrease ensures a substantial reduction of damage to the fiber. However, in order to ensure these advantages, it is important that according to the invention the per compound and the surfactant are not introduced separately into the impregnating liquor, but that first the mixture of per compound and surfactant is prepared and this mixture is then added to the liquor.

The following examples illustrate the invention without limiting it in its scope. The percentages are by weight.

EXAMPLE 1

Grey cotton cloth sized with starch was impregnated with a solution having the following composition:

6.0% of sodium hydroxide 1.5% of persulfate/surfactant mixture having the following composition:

- 5.0% of nonylphenol-polyglykol ether + 8 mols of ethylene oxide
- 30.0% of secondary alkanesulfonate ($C_{11}$–$C_{17}$)
- 7.0% of peroxydisulfate (sodium salt)

remainder: water

The impregnated material was squeezed to 100% of moisture content, and steamed on a steamer at 103°–105° C. Subsequently, the material was washed free from alkali by means of hot water.

The cloth so treated has a degree of whiteness of 66.7%. The desizing degree, measured according to the violet scale TEGEWA, is 8–9. The average polymerization degree (AP) of the material treated is 2550.

EXAMPLE 2

Cotton cloth as in Example 1 was impregnated with a solution having the following composition:

3.0% of sodium hydroxide 1.5% of persulfate/surfactant combination having the following composition:

10.0% of $C_{10}$–$C_{14}$-fatty alcohol polyglycol ether +6 mols of ethylene oxide 10.0% of secondary alkanesulfonate ($C_{11}$–$C_{17}$)

7.0% of peroxydisulfate ($NH_4$ salt)

remainder: water

The impregnated material was squeezed to 100% of moisture content, wound up and maintained in a steam atmosphere for 1 hour at 95° C. and 100% of relative moisture. Subsequently, the material was treated as in Example 1.

The material so treated has a degree of whiteness of 67.2%. The desizing degree, measured according to the violet scale TEGEWA, is 8–9. The AP of the material is 2500.

EXAMPLE 3

Grey cotton cloth as in Example 1 was impregnated with a solution having the following composition:

4.0% of hydrogen peroxide 35% strength 2.0% of sodium silicate 36°–38° Bé

1.0% of sodium hydroxide 1.0% of persulfate/surfactant combination, composition as follows:

30.0% of nonylphenol-polyglycol ether+6 mols of ethylene oxide 5.0% of secondary alkanesulfonate ($C_{11}$–$C_{17}$)

17.0% of peroxydisulfate ($NH_4$-salt)

remainder: water

The impregnated material was squeezed to 100% of moisture content, wound up on a batching roller and wrapped with a plastics sheet in order to avoid drying. The roller containing the fabric was then left standing for 16–20 hours at room temperature. Thereafter the fabric was washed out with addition of alkali to the first washing baths.

The material so treated has a degree of whiteness of 85%, a desizing degree, measured according to violet scale TEGEWA, of 9, and an AP value of 2450.

EXAMPLE 4

Grey cotton cloth as in Example 1 was impregnated with a solution having the following composition:

3.0% of hydrogen peroxide 35% strength 1.0% of sodium silicate 36–38 Bé

0.6% of sodium hydroxide 3.0% of persulfate/surfactant combination, composition as follows:

5.0% of $C_{10}$–$C_{14}$-fatty alcohol polyglycol ether+5 mols of ethylene oxide 30.0% of secondary alkanesulfonate ($C_{11}$–$C_{17}$)

7.0% of peroxydisulfate (sodium- or $NH_4$-salt)

remainder: water.

The impregnated material was squeezed to 100% of moisture content, and treated on a steamer with steam of 100°–102° C. Subsequently, the goods were washed while adding alkali to the first washing baths.

The material so treated has a degree of whiteness of 84%. The desizing degree, measured according to the violet scale TEGEWA, is 8–9, and the AP value is 2400.

EXAMPLE 5

Grey cotton cloth sized with starch was impregnated with a solution having the following composition:

6.0% of sodium hydroxide 1.5% of peroxo-diphosphate/surfactant mixture, composition as follows:

5.0% of nonylphenol-polyglycol ether+8–10 mols of ethylene oxide 30.0% of secondary alkanesulfonate ($C_{11}$–$C_{17}$)

8.0% of peroxo-diphosphate (sodium salt)

remainder: water.

The material so impregnated was squeezed to a moisture content of 100% and treated on a steamer with steam having a temperature of 103°–105° C. Subsequently, the goods were washed until they were free from alkalis.

The material so treated has a degree of whiteness of 68.6%. The desizing degree thereof, measured according to the violet scale TEGEWA, is 8. The average polymerization degree (AP) of the treated material is 2400.

EXAMPLE 6

Grey cotton cloth as in the preceding Example was impregnated with a solution having the following composition:

5.0% of hydrogen peroxide 35% strength 2.0% of sodium silicate 36–38 Bé

1.0% of sodium hydroxide 1.5% of peroxo-diphosphate/surfactant mixture, composition as follows:

30.0% of nonylphenol-polyglycol ether+10 mols of ethylene oxide 5.0% of secondary alkanesulfonate ($C_{11}$–$C_{17}$)

15.0% of peroxodiphosphate (ammonium salt)

remainder: water

The impregnated material was squeezed to a moisture content of 100%, wound up on a batching roller and wrapped in a plastics sheet in order to avoid drying. The roller with the material was then left standing for 16–20 hours at room temperature. Thereafter, the material was washed with addition of alkali to the first washing baths.

The whiteness degree of the goods so treated is 84%, the desizing degree, measured according to the violet scale TEGEWA, is 7–8, and the AP value is 2300.

What is claimed is:

1. Oxidative desizing agent consisting substantially of from 5 to 20 weight % of sodium or ammonium persulfate or potassium, sodium, ammonium or calcium peroxodiphosphate, from 20 to 50 weight % of one or more surfactants selected from the group of $C_8$–$C_{20}$-sec.-alkanesulfonates, $C_4$–$C_{12}$-alkylphenol-oxethylates having 6 to 12 ethylene oxide moieties, or $C_{10}$–$C_{18}$-fatty alcohol-oxethylates having 3 to 8 ethylene oxide moieties, and water in the amount remaining to give 100%.

2. Oxidative desizing agent as claimed in claim 1, which comprises an alkanesulfonate and an alkylphenol-oxethylate or fatty alcohol oxethylate in a weight ratio of from 1:6 to 6:1.

* * * * *